US007303649B2

(12) United States Patent
Brelid et al.

(10) Patent No.: US 7,303,649 B2
(45) Date of Patent: Dec. 4, 2007

(54) REMOVAL OF INORGANIC ELEMENTS FROM WOOD CHIPS

(75) Inventors: Harald Brelid, Gothenborg (SE); Peter Axegard, Solna (SE)

(73) Assignee: STFI Skogsindustrins Tekniska Forskningsinstitut AB, Stockholm (SE)

( * ) Notice: Subject to any disclaimer, the term of this patent is extended or adjusted under 35 U.S.C. 154(b) by 158 days.

(21) Appl. No.: 10/496,119

(22) PCT Filed: Nov. 22, 2002

(86) PCT No.: PCT/SE02/02137

§ 371 (c)(1),
(2), (4) Date: May 19, 2004

(87) PCT Pub. No.: WO03/046276

PCT Pub. Date: Jun. 5, 2003

(65) Prior Publication Data

US 2005/0034823 A1 Feb. 17, 2005

(30) Foreign Application Priority Data

Nov. 30, 2001 (SE) ..... 0104024

(51) Int. Cl.
*D21C 1/04* (2006.01)
*D21C 1/10* (2006.01)

(52) U.S. Cl. ..... 162/18; 162/19; 162/38; 162/76

(58) Field of Classification Search ..... 162/60, 162/17–19, 53, 56, 72, 76, 37–39
See application file for complete search history.

(56) References Cited

U.S. PATENT DOCUMENTS

| | | | | |
|---|---|---|---|---|
| 2,985,236 | A | 5/1961 | Ranhagen | |
| 4,826,567 | A | 5/1989 | Gratzl | |
| 5,593,544 | A * | 1/1997 | Fahlgren et al. | 162/65 |
| 6,413,367 | B1 * | 7/2002 | Svedman et al. | 162/68 |
| 6,533,896 | B1 * | 3/2003 | Tikka et al. | 162/19 |

FOREIGN PATENT DOCUMENTS

| | | |
|---|---|---|
| DE | 1 074 389 | 1/1960 |
| EP | 0 494 519 | 7/1992 |
| EP | 0 921 228 | 6/1999 |
| SE | 174656 | 3/1961 |
| WO | WO 95/02726 | 1/1995 |

* cited by examiner

*Primary Examiner*—Eric Hug
(74) *Attorney, Agent, or Firm*—Young & Thompson

(57) ABSTRACT

In a process of treating wood chips for reduction of the concentration of undesirable inorganic elements prior to cooking in a production line for chemical pulp, the wood chips, having entrapped air, are treated with an aqueous leaching liquor at elevated temperature and pressure, followed by draining at atmospheric pressure or below atmospheric pressure, the pressures being controlled to yield a moisture content in the wood chips as low as possible for adequate leaching result and behavior of the chips in a subsequent digester. The aqueous leaching liquor is e.g. pulp mill process water with a low content of undesirable inorganic components, such as bleach plant spent liquor or condensate. The aqueous leaching liquor drained from the treated wood chips may be purified and recycled back to the process.

20 Claims, 1 Drawing Sheet

REMOVAL OF INORGANIC ELEMENTS FROM WOOD CHIPS

Figure 1:
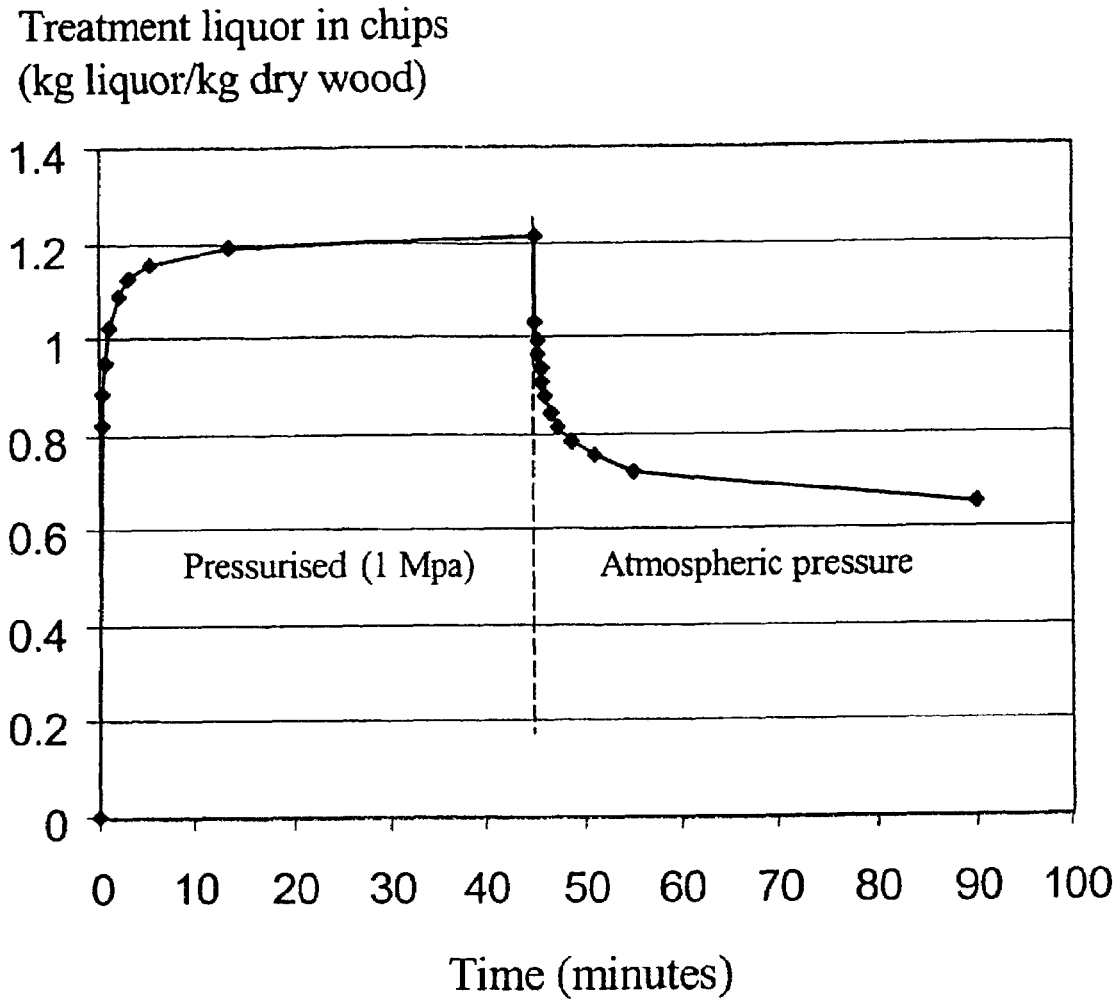

The present invention relates to removal of inorganic elements from wood chips. More precisely, the invention relates to a process step in a production line for chemical pulp wherein wood chips, having entrapped air, are treated with aqueous leaching liquor under certain conditions for reduction of the concentration of undesirable inorganic elements in the chips prior to cooking in a digester. The removal of inorganic elements from wood chips according to the present invention is accomplished in such a way that the increase in wood moisture content during the treatment is controlled.

BACKGROUND OF THE INVENTION

As pulp mill plants strive to further decrease usage of fresh water from current levels by means of closed looped systems, the concentration of non-process elements within the manufacturing process, i.e. undesirable inorganic elements, will tend to increase in different process streams. This might have a negative impact on process chemistry, scale formation, process efficiency and product properties. Such undesirable inorganic elements are e.g. aluminum, calcium, barium, phosphorus, chlorine, potassium, manganese, cadmium, magnesium, iron, and zinc. Undesirable inorganic elements from the wood raw material and from chemicals used to manufacture bleached pulp from wood will accumulate in different process streams, due to recirculation of process streams such as bleach plant filtrates.

Accumulation of undesirable inorganic elements in a pulp mill often causes problems with scaling which leads to plugging of pipes, screens, instruments etc, which in turn may result in lost production or other process disturbances. Some elements such as iron and/or manganese may interfere with chemical reactions in bleaching and cause inferior pulp quality and decomposition of valuable hydrogen peroxide. Chloride and potassium ions accumulate in the recovery boiler system and contribute to the plugging and corrosion of the boiler tubes that may lead to lost production.

Among the different measures to minimize or eliminate the effluent from chemical pulp mills, closure of the bleach plant poses a great challenge. Therefore, management of undesirable inorganic elements would be a key to successful recovery and recycle of bleach plant effluents. Any pulp mill aiming at advanced closure must anticipate, and strive to prevent, the negative impacts of built-up undesirable inorganic elements.

A number of different treatment methods for removal of undesirable inorganic elements from wood material prior to chemical pulping have been proposed previously. Many of these methods involve changes in the water balance of the pulping process, mainly due to increased wood moisture content resulting from the treatment method.

For example, one previously proposed method for removal of metals in pulping processes is disclosed in SE 502,667. A method is described, in which comminuted fiber material is treated prior to digestion in the presence of a liquid containing a sequestering agent that forms complexes together with metals in the fiber material. The treatment is carried out prior to or during the performed pre-impregnation before digestion, and is performed at a pH value above 5.0. At least a part of the liquid containing the sequestering agent consists of spent liquor, fresh digestion liquid, effluent from bleaching processes, condensation, mains water or lake water, or mixtures thereof. The spent liquor used is suitably the spent liquor having reduced, low content of metals that is obtained at the digestion, which follows the disclosed treatment with sequestering agent.

Another method involving removal of metal ions is disclosed in U.S. Pat. No. 4,826,568, wherein a process for delignification of lignocellulosic substances is described. This process comprises treatment of a lignocellulosic material in a first stage with an inorganic acid at a pH of 1-4, in presence of diethylenetriaminepentaacetic acid or a metal salt thereof, to sequester metal ions. Then the cellulosic material is treated in a second stage with hydrogen peroxide to accelerate delignification of the lignocellulosic material and retard carbohydrate degradation during subsequent digestion. Water washing of the treated lignocellulosic material of the second stage, and digestion of the water washed lignocellulosic material in a kraft digester produce a paper pulp.

EP 0 921 228 A2 discloses a method of preparing chemical pulp from wood chips, in which method wood chips are treated in a precleaning stage prior to cooking, in order to remove process detrimental components. In the precleaning stage, wood chips are treated with e.g. bleach filtrate or evaporation condensate at a pH of 2.5-5.

However, treatment of wood chips with a water solution prior to digestion leads to increased moisture content in the chips entering the digester. The increased moisture content in the chips will result in larger volumes of spent cooking liquor. Since evaporation of spent cooking liquor consumes valuable steam, such a water treatment has a negative influence on the energy balance of the pulping process in comparison with traditional pulping methods. For economic reasons it is of great importance to minimize the created increased moisture content of the treated chips prior to cooking.

None of the prior art methods addresses the problem of created increased moisture content in the treated wood chips after reduction of the concentration of undesirable inorganic elements in the chips prior to cooking.

In pulping processes steaming is generally performed to replace air in the wood chips by steam. This may be done prior to leaching with a water solution to reduce the content of undesirable inorganic elements in wood chips, as well as prior to cooking in a digester. During the subsequent impregnation of the wood chips with leaching or cooking liquor, the steam in the chips is condensed, which leads to a lowered pressure inside the chips. This, in combination with the impregnation being performed under an elevated pressure, leads in turn to that leaching or cooking liquor penetrates into the chips. During the impregnation process, the density of the chips increases since a considerable part of the originally air-filled spaces in the chips become filled with leaching or cooking liquor, the more the higher the surrounding pressure. It is important that the density of the impregnated chips exceeds the density of the cooking liquor in a continuous digester so that the chips will sink in the digester. As the steaming treatment consumes a relatively large amount of steam, an elimination or reduction of the need of steaming treatment would involve a great energy saving to the pulp mill.

SHORT DESCRIPTION OF THE INVENTION

The present invention does not require any steaming for replacement of air in wood chips. On the contrary, the present invention makes use of the entrapped air in wood chips. When an excess pressure (above the atmospheric pressure) is applied on the aqueous liquor surrounding the wood chips having entrapped air, the liquor will penetrate into the chips (for leaching) and the entrapped air will be compressed. As the excess pressure is released and atmospheric pressure eventually is reached, or a sub-atmospheric pressure is applied, the compressed air will eject the liquor from the wood chips. Undesirable inorganic elements are leached from the wood chips mainly during the time of period under which an excess pressure is applied. The ejection of aqueous leaching liquor from the wood chips occurring when the excess pressure is released will give an additional removal of inorganic elements from wood chips since the ejected liquor will be relatively rich in undesirable inorganic elements. This method results in dryer chips after draining than prior art methods and leads to less consumption of energy for removal of excess water after cooking.

The present invention also provides an opportunity for the regulation of the increase of wood moisture content caused by the treatment method for removal of undesirable inorganic elements. This regulation is e.g. accomplished by use of different pressures during the treatment leaving more or less liquor in the chips, thus adjusting the density of the wood chips after the treatment to the conditions of the subsequent digester.

DETAILED DESCRIPTION OF THE INVENTION

The present invention provides a new concept of reducing the contents of undesirable inorganic elements from wood chips prior to cooking. In particular, the invention provides a process step in a process of treating wood chips for reduction of the content of undesirable inorganic elements prior to cooking in a production line for chemical pulp, wherein the wood chips, having entrapped air, are treated with an aqueous leaching liquor at a temperature of 40-120° C., and at a pressure of at least 0.1 MPa (e) for 5-240 minutes, followed by draining at atmospheric pressure or below atmospheric pressure, the pressures being controlled to yield a moisture content in the wood chips as low as possible for adequate leaching result and behavior of the chips in a subsequent digester.

The draining is performed in order to remove aqueous leaching liquor that contains undesirable inorganic elements from the wood chips: However, the draining should result in a moisture content in the wood chips as low as possible for adequate or predetermined leaching result, i.e. removal of undesirable inorganic elements from the wood chips, and adequate or pre-determined behavior of the chips in a subsequent digester, i.e. control of the density of the wood chips to match the requirements in the selected subsequent digester.

In a presently preferred embodiment of the invention the moister content of the drained wood chips is controlled to yield a density of the drained wood chips that is higher than the density of the cooking liquor in a subsequent continuous digester at the prevailing digester pressure.

The entrapped air in the wood chips to be treated is the air occurring in untreated wood chips and/or is supplied by subjecting the wood chips to elevated pressure in air, prior to the leaching liquor treatment of the invention.

In the present specification, claims and drawing, all pressures indicated in MPa are excess pressures (MPa (e)), i.e. pressures above atmospheric pressure.

In another presently preferred embodiment of the invention the aqueous leaching liquor treatment is carried out at a pressure of 0.1-1.0 MPa (e) and a temperature of 50-110° C. for 15-240 minutes, e.g. at a pressure of 0.1-0.8 MPa (e) temperature of 60-100° C. for 30-120 minutes. The lower pressure limit is indicated to show that an excess pressure is needed for the compression of entrapped air. The upper pressure limit is only a practical limit since it would be costly to use higher pressures even though the invention would be operable at even higher pressures. The time and temperature limits are only practical limits useful in the practice of the invention, and some leaching effect would certainly be seen also outside the given intervals.

Final pH of the Aqueous Leaching Liquor

The final pH of the aqueous leaching liquor after treatment is not critical to the invention, but the pH may be decisive for which undesirable elements are leached from the chips. For instance, at neutral pH monovalent cations, such as $K^+$ and anions, such as $Cl^-$, are predominantly leached from the chips, whereas acidic pH promotes leaching of divalent cations, such as $Mn^{2+}$ and $Ca^{2+}$. The desired pH may be accomplished by addition of an inorganic acid, such as for instance sulfuric acid, to the aqueous leaching liquor. Generally, low pH in the leaching treatment promotes the removal of undesirable metal cations from the wood material. As the pH is lowered, a larger part of the carboxylic groups in the wood components becomes protonated, which leads to a liberation of undesired metal cations in the wood material. However, treatment under acid conditions involves a risk of acid hydrolysis of the carbohydrates in the wood material. If the conditions during the treatment are too severe (low pH, high temperature, long retention time), the pulp yield and the strength properties of the pulp are negatively affected. It is therefore evident that the choice of treatment conditions is a balance between the wanted degree of reduction of the concentration of undesirable inorganic elements and the risk of decrease of pulp yield and pulp strength.

In a preferred embodiment of the invention the aqueous leaching liquor treatment is carried out at a final pH of 1.5-5, more preferably at a final pH of 2-4, and most preferably at a final pH of 2.5-3.5.

Aqueous Leaching Liquor

The aqueous leaching liquor used in the treatment may be any aqueous liquor with a low content of inorganic elements that are undesirable in a pulping process, such as pulp mill process water with a low content of undesirable inorganic components, e.g. bleach plant spent liquor or condensate.

Suitable pulp mill process water for use in the present invention could be for example pulp mill effluents, bleach plant process water, and bleach plant effluents. In some embodiments of the invention, the pulp mill process water is a condensate, in particular a black liquor evaporation condensate.

In a preferred embodiment, the process water is bleaching plant process water, in particular bleaching stage filtrates with low or nonexistent peroxide content. The bleaching stage filtrate may be a spent bleaching liquor from a chlorine dioxide treatment stage (D-stage), an ozone treatment stage (Z-stage), a peracetic acid stage (Paa-stage), a sequestering treatment stage (Q-stage, treatment with sequestering agent in slightly acidic solution), an acid stage using a mineral acid (A-stage, acidic treatment), an E-stage (alkali extraction stage), EO-stage (combined oxygen and alkali extraction stage), PO-stage (pressurized peroxide stage combined with some oxygen addition), P-stage (peroxide stage), or OP-stage (combination of pressurized peroxide and oxygen stage), an acidified alkaline stage, or a combination thereof.

Drained Aqueous Leaching Liquor

In another preferred embodiment of the invention the aqueous leaching liquor drained from the treated wood chips is purified and recycled back to the aqueous leaching liquor treatment.

If desired, the drained aqueous leaching liquor can be purified by methods such as chemical precipitation followed by flotation or sedimentation, membrane filtration or ion exchange or other separation techniques, in order to remove undesirable inorganic elements leached from the wood chips. Lipophilic extractive components such as resins and terpenes in the effluent can be recovered by flocculation and flotation or membrane filtration. Such recovered lipophilic extractive components have a higher purity than ordinary sulfate turpentine and crude tall oil since they are not affected by the digestion process. The spent and drained pulp mill process water effluent from the leaching treatment of the present invention may also be conveyed to an external wastewater purification plant. The effluent may also be evaporated and conveyed to an incineration plant.

Balancing of Moisture Content in Wood Chips After Aqueous Leaching Treatment

As previously untreated wood chips are impregnated with an aqueous leaching liquor under pressure, portions of entrapped air, i.e. air remaining enclosed within the wood chips are compressed to such a small volume that the aqueous leaching liquor can reach a sufficient contact with the wood material. The present invention provides an opportunity for the regulation of the increase of wood moisture content caused by the treatment method for removal of undesirable inorganic elements. In a preferred embodiment of the invention, the density of the drained wood chips should be, after impregnation with cooking liquor, higher than the density of the cooking liquor in a subsequent continuous digester at the prevailing digester pressure. This regulation is accomplished by adapting the impregnation pressure to the wood type and initial moisture content of the chips to be treated, thus adjusting the density of the wood chips after the treatment to the conditions of the subsequent digester.

Density of Impregnated Wood Chips and Movement of Wood Chip Column

In continuous down flow processes, such as continuous digesters, a regular movement of the chip column is required for good control of the treatment. The chip column is driven by a net pressure from the top, the difference in density between the impregnated wood chips in the vessel and the surrounding liquor being the main component. To this difference in density, a pressure from the top of the part of the chip column that is above the liquor surface, if present, and the pressure from a possible down flow should be added Against the mentioned difference in density acts the friction between the chip column and the vessel wall, especially at withdrawal screens, and the counter pressure due to possible counter flow, e.g. counter-current washing in continuous digesters. In totally liquor-filled vessels, e.g. so-called hydraulic digesters, the pressure from a chip column above the liquor surface does not exist. In modem so-called steam-liquid phase the pressure from the chip column above the liquor surface has been reduced by making the cross-section of the digester considerably smaller at the top of the digester than further down. The pressure from the top as well as from the bottom affects the packing of the wood chips in the vessel and thus the duration in the digester. Therefore, it is important to keep the different pressure components as constant as possible. The chip column is at normal packing degrees more or less elastic, and this may affect the duration and result of the process considerably.

Normally the difference in density between impregnated chips and surrounding liquor should be positive to ensure movement of the chip column. However, the rest of the forces may compensate for a negative difference, if the difference is not too big, but in that case there is a considerable uncertainty. Therefore, at the planning stage, the difference in density should be at least zero and preferably positive. The difference in density between impregnated chips and surrounding liquor can be calculated according to established procedures (See e.g. Johan Gullichsen, Papermaking Science and Technology, Book 6A, Chemical pulping, p.A250) as follows:

Density of the dry raw wood=$d_w$, tons of absolutely dry wood/$m^3$ volume of wet wood, interval approx. 0.3-0.6, for Swedish softwood normally 0.38-0.42, for hardwood normally higher, birch approx. 0.5, eucalyptus normally approx. 0.5-0.6.

Density of dry wood substance=$d_{ws}$, tons of absolutely dry wood/$m^3$ volume of wet wood substance, approx. 1.5.

Content of dry wood=dc, %, unstored wood normally in the interval 50-60%, stored wood 60—in excess of 70%.

Pressure in process=p, bar absolute, i.e. 0.1 Mpa absolute

Density of the impregnation liquor=$d_{liq}$, t/$m^3$, water approx. 1.0, and cooking liquor approx. 1.1.

Density of impregnated wood chips at actual pressure and equilibrium $$=d_w\times[1+(100-dc)/dc+d_{liq}\times(1-1/p)\times(1/d_w-1/d_{ws}-(100-dc)/dc)]$$

At density of dry raw wood of 0.4, content of dry wood of 65%, pressure of 6 bar absolute and density of cooking liquor of 1.1 as impregnation liquor, the density of the impregnated wood chips is $$=0.4\times[1+35/65+1.1\times(1-1/6)\times(1/0.4-1/1.5-35/65)]=0.4\times[1+0.538+1.08\times0.833\times(2.5-0.667-0.538)]=1.09$$

The wood chips will not sink spontaneously if the surrounding liquor is cooking liquor with a density of 1.1.

If the impregnation is done with water, as is the case when wood chips are leached prior to digestion for removal of inorganic elements according to the invention, the following result is obtained instead $$0.4\times[1+45/55+1\times(1-1/4)\times(1/0.4-1/1.5-45/55)]=0.4\times[1+0.818+1\times0.75\times(2.5-0.667-0.818)]=1.032$$

In this case, with an aqueous leaching liquor having approximately the density of water, the wood chips will sink.

The main purpose of the aqueous leaching treatment is to remove undesirable inorganic elements from the wood chips. The present invention relates to a process in which the increase in wood chip moisture content due to the aqueous leaching treatment is kept on a low level. However, by adapting different pressure levels during the treatment it may also be possible to regulate the moisture content of the wood chips in order to ensure a proper behavior of the wood chips in the digester.

The balancing of moisture content is especially important when using low-density wood (density approx. 400 kg absolutely dry wood/$m^3$ in moist volume), such as Scandinavian softwood. When using fresh softwood chips that have a relatively high original moisture content (normally 40-50%), comparatively low pressures (0.1-0.4 MPa) will be sufficient to reach a satisfying remaining moisture content after impregnation, whereas dry softwood chips (moisture content <35%) require a greater amount of remaining water after drainage and thus a higher impregnation pressure in order to achieve impregnated chips having a high enough moisture content for them to sink inside the digester. A resulting moisture content of treated softwood chips of about 1.0-1.7 $m^3$/t oven-dry wood would normally be sufficient to ensure proper behavior in the digester. It may be mentioned in this context that the upper limit of the interval concerns low-density wood, whereas the lower limit is enough for high-density wood. Thus, high-density wood chips (density above 450 kg absolutely dry wood/$m^3$ moist volume), such as Southern pine and many hardwood species, will generally require lower pressures. By adjusting the pressure, the method of the present invention can thus be adapted for treatment of all types of wood chips.

Thus, the leaching treatment according to the invention performed under an elevated pressure thus serves two purposes: effective removal of undesirable inorganic elements and when necessary achievement of a balanced chip moisture content that will ensure proper behavior of the chips in the digester.

Processing of Drained Wood Chips

After draining, the wood chips treated according to the present invention, are transferred to the digestion process. The treatment of the present invention is well adapted to continuous processes. In a continuous process the leaching treatment of the chips prior to digestion is preferably performed in a separate vessel. A major advantage of separate vessels is that the choice of vessel materials can be adapted to the process conditions of each process stage. The treatment can also be carried out as a counter current leaching in a continuous process, which will add a final washing effect to the leaching process. The treatment prior to cooking could also be performed directly in batch digesters. A loss in digester capacity would, however, be experienced in that case. The leaching treatment of the present invention can be followed by alkaline pulping methods e.g. for production of kraft pulp, although the invention is not limited to such methods. The pulping liquor of the subsequent cooking process may be black liquor, green liquor, white liquor, or a combination thereof.

The present invention will now be illustrated by a drawing and examples, but it should be understood that the invention is not limited to the disclosed embodiments.

SHORT DESCRIPTION OF THE DRAWING

FIG. 1 shows a diagram that illustrates penetration of treatment liquor during the pressurized phase of the impregnation of spruce chips followed by an ejection of treatment liquor from the wood chips due the lowering of the pressure to atmospheric pressure.

EXAMPLES

Example 1

Spruce wood chips (150 g dry weight) were placed in an autoclave (1.5 $dm^3$). The dry content of the chips was 62%. Acid leaching treatment liquor (0.5 g $H_2SO_4/dm^3$ water) was added before the lid was put on. The treatment was carried out at 60° C. and preheated diluted sulfuric acid was used and the autoclave was placed in a preheated water bath. Air (not entrapped in the wood chips) remaining in the autoclave was removed by the introduction of the same treatment liquor, through a valve and simultaneous removal of air through a valve placed at the top of the sealed autoclave. When the autoclave was hydraulically filled, the valve at the top was closed and the same treatment liquor was then introduced to the autoclave with a pressure of 1 MPa (e). The amount of liquor entering the autoclave during the pressurizing was measured by weighing. After 45 minutes of pressure, the valve at the top of the autoclave was opened (yielding an atmospheric pressure in the autoclave). The amount of liquor leaving the autoclave when the pressure was lowered was measured by weighing. The diagram in FIG. 1 shows the penetration of treatment liquor during the pressurized phase of the impregnation (1 MPa (e), 60° C., 45 min.) of spruce chips followed by a decrease in uptake due to ejection of treatment liquor from the chips by the compressed entrapped as the pressure was released and returned to atmospheric pressure (45 min). As can be seen from FIG. 1, air entrapped in the wood chips is compressed as a consequence of the increased pressure, and treatment liquor penetrates the chips. When the pressure is lowered to atmospheric pressure, the air entrapped in the wood chips expands forcing the treatment liquor out of the wood chips, resulting in a lower moisture content of the chips.

Example 2

A series of leaching treatments of spruce wood chips, i.e. full cell impregnation treatment, and pressure impregnation was conducted. When the wood chips were subjected to full cell impregnation treatment an air-removing step (vacuum treatment) prior to the impregnation was included. The spruce wood chips (150 g dry weight) were placed in an autoclave (1.5 $dm^3$). The dry content of the chips was 62%. The autoclave was evacuated for 30 minutes after which diluted sulfuric acid (0.5 g $H_2SO_4/dm^3$ water) was sucked in. Thereafter, the autoclave was pressurized for 90 minutes at 1 MPa (e). In the treatments consisting of a pressure impregnation (without any air removing step prior to the impregnation), the chips (150 g dry weight) were placed in the autoclave and the same treatment liquor was added before the lid was put on. Air (not entrapped in the wood chips) remaining in the autoclave was removed by the introduction of the same treatment liquor through a valve and simultaneous removal of air through a valve placed at the top of the sealed autoclave. When the autoclave was hydraulically filled, the valve at the top was closed and the same treatment liquor was then introduced to the autoclave with a certain pressure (0.1-0.8 MPa (e)). After 45 minutes of excess pressure, the valve at the top of the autoclave was opened (yielding an atmospheric pressure in the autoclave). After completed treatment, the chips were dewatered on a Buchner funnel and weighed. When the treatments were carried out at 60° C. preheated diluted sulfuric acid was used and the autoclave was placed in a preheated water bath. The pH of the treatment liquor was 2.4 after completed treatment. The contents of Mn and Ca in the wood chips prior to and after the treatments were analyzed by means of atomic absorption spectrometry after wet digestion with $HNO_3$.

Table 1 shows the moisture content in the spruce chips subjected to different treatment procedures. The treatment procedures studied were (full cell impregnation with a total retention time of 90 minutes and pressure impregnation followed by a pressure release (45 min.+45 min.). The removal of Mn and Ca obtained by leaching during the treatment is also included in the table. The content of Mn and Ca in the untreated chips was 132 and 843 mg/kg dry wood, respectively.

| Leaching treatment | Temperature | Moisture in chips after leaching treatment (kg/kg dry wood) | Removal of Mn by leaching treatment (% of original) | Removal of Ca by leaching treatment (% of original) |
|---|---|---|---|---|
| Full cell impregnation | Room temperature | 1.98 | 35 | 34 |
| Pressure impregnation 1 MPa (e) | Room temperature | 1.55 | 42 | 37 |
| Full cell impregnation | 60° C. | 1.91 | 44 | 44 |
| | | Pressure impregnation | | |
| 0.1 MPa (e) | 60° C. | 1.21 | 40 | 45 |
| 0.2 MPa (e) | 60° C. | 1.26 | 44 | 51 |
| 0.4 MPa (e) | 60° C. | 1.48 | 49 | 54 |
| 0.6 MPa (e) | 60° C. | 1.50 | 46 | 52 |
| 0.8 MPa (e) | 60° C. | 1.55 | 46 | 52 |

The results in Table 1 show that choosing different pressure levels can control the moisture content of the chips. This means that the moisture content of the treated wood chips can be kept as low as possible, but, when necessary, high enough to give a density of the wood chips in the digester that is higher than the surrounding cooking liquor at the prevailing digester pressure of the cook. It is also evident that the present process, which includes a partial removal of aqueous leaching liquor from the wood chips, can be controlled to give a more extensive reduction of the concentration of undesirable inorganic elements than a process in which the partial aqueous leaching liquor removal is omitted.

In summary, the present invention provides several advantages. Not only is the reduction of the concentration of undesirable inorganic elements equally to or more efficient than achieved in the prior art, but the invention is also less dependent upon additives such as sequestering agents. Further, the invention provides for a balanced moisture content of the wood chips entering the cooking process, involving as little as possible net increase in wood chips moisture content, but enough to secure a proper behavior of the impregnated chips in the cooking process;

minimizes the increase in spent cooking liquor volumes minimizes or eliminates scaling problems in the bleach plant;

minimizes plugging and corrosion of the recovery boiler tubes;

minimizes the dead-load, i.e. non-active chemicals, in the lime cycle.

The invention claim is:

1. A process of treating wood chips for reduction of the content of undesirable inorganic elements prior to cooking in a production line for chemical pulp, comprising:

treating wood chips, having entrapped air, with an aqueous leaching liquor at a temperature of 40-120° C. and at a pressure of at least 0.1 MPa (e) for 5-240 minutes; and draining the treated wood chips having entrapped air at atmospheric pressure or below atmospheric pressure, the pressures being controlled to yield a moisture content in the wood chips sufficiently low for leaching undesirable inorganic elements from the wood chips and ensuring proper behavior of the chips in a subsequent digester.

2. The process according to claim 1, further comprising providing wood chips having entrapped air, wherein said entrapped air occurs in untreated wood chips and/or is supplied by subjecting wood chips to an elevated pressure in air to obtain wood chips having entrapped air.

3. The process according to claim 1, wherein the moisture content of the drained wood chips is controlled to yield a density of the drained wood chips that is higher than the density of the cooking liquor in a subsequent continuous digester at the prevailing digester pressure.

4. The process according to claim 1, wherein the aqueous leaching liquor treatment is carried out at a final pH of 1.5-5.

5. The process according to claim 4, wherein the aqueous leaching liquor treatment is carried out at a final pH of 2-4.

6. The process according to claim 5, wherein the aqueous leaching liquor treatment is carried out at a final pH of 2.5-3.5.

7. The process according to claim 1, wherein the aqueous leaching liquor treatment is carried out at a pressure of 0.1-1.0 MPa (e) and a temperature of 50-110° C. for 15-240 minutes.

8. The process according to claim 6, wherein the aqueous leaching liquor treatment is carried out at a pressure of 0.1-0.8 MPa (e) and a temperature of 60-100° C. for 30-120 minutes.

9. The process according to claim 1, wherein the aqueous leaching liquor used in the treatment is pulp mill process water with a low content of undesirable inorganic components.

10. The process according to claim 9, wherein the pulp mill process water is bleach plant spent liquor or condensate.

11. The process according to claim 1, wherein the aqueous leaching liquor drained from the treated wood chips is purified and recycled back to the aqueous leaching liquor treatment.

12. The process according to claim 1, wherein the moisture content in the wood chips resulting from draining is of 1.0-1.7 $m^3$ moisture/ton oven dry wood.

13. The process according to claim 1, wherein said undesirable inorganic elements are selected from the group consisting of aluminum, calcium, barium, phosphorous, chlorine, potassium, manganese, cadmium, magnesium, iron, zinc, and combinations thereof.

14. A process of treating wood chips having entrapped air for reduction of the content of undesirable inorganic elements, prior to cooking in a production line for chemical pulp, comprising the steps of:

treating wood chips having entrapped air with an aqueous leaching liquor at a temperature of 40-120° C. and a pressure of at least 0.1 MPa (e) for 5-240 minutes such that said leaching liquor penetrates the wood chips for reduction of undesirable inorganic elements and said entrapped air is compressed; and draining said leaching liquor by exposing said treated wood chips to atmospheric pressure or below atmospheric pressure to cause said compressed entrapped air to eject leaching liquor from said wood chips, wherein said pressure is controlled such that a desired reduction of undesirable inorganic elements and a desired moisture content of the wood chip are achieved.

15. The process according to claim 14, wherein said desired moisture content in said draining step is 1.0-1.7 $m^3$ moisture/ton oven dry wood.

16. The process according to claim 14, wherein said treating step is carried out at a final pH of 1.5-5.

17. The process according to claim 14, wherein said desired reduction of undesirable inorganic elements is sufficient to minimize scaling problems, chemical reaction interference with, and plugging and corrosion in subsequent steps in a production line.

18. The process according to claim 14, wherein said undesirable inorganic elements are selected from the group consisting of aluminum, calcium, barium, phosphorous, chlorine, potassium, manganese, cadmium, magnesium, iron, zinc, and combinations thereof.

19. A process of treating wood chips having entrapped air for reduction of the content of undesirable inorganic elements, prior to cooking in a production line for chemical pulp, comprising the steps of:

treating wood chips having entrapped air with an aqueous leaching liquor for reducing of the content of said undesirable inorganic elements in said wood chips, wherein, said treating is at a pressure of at least 0.1 MPa Ce) for a time sufficient for said leaching liquor to penetrate said wood chips and to compress said entrapped air within said woodchips; and exposing said treated wood chips to a pressure equal to or less than atmospheric pressure such that said treated wood chips are drained of leaching liquor to reduce the content of undesirable inorganic elements in the wood chips and yield a density of the drained wood chips that is higher than the density of the cooking liquor in a subsequent continuous digester at the prevailing digester pressure, wherein said undesirable inorganic elements are selected from the group consisting of aluminum, calcium, barium, phosphorous, chlorine, potassium, manganese, cadmium, magnesium, iron, zinc, and combinations thereof.

20. The process according to claim 19, wherein said treating step is carried out at a pressure of 0.1-1.0 MPa (e) and a temperature of 50-110° C. for 15-240 minutes.

* * * * *